US005373773A

United States Patent [19]

Groves

[11] Patent Number: 5,373,773

[45] Date of Patent: Dec. 20, 1994

[54] ANTI-TORPEDO STERN DEFENSE SYSTEM

[75] Inventor: Kenneth W. Groves, Forest Hills, N.Y.

[73] Assignee: The United States of American as represented by the Secretary of the Navy, Washington, D.C.

[21] Appl. No.: 290,445

[22] Filed: Aug. 6, 1981

[51] Int. Cl.[5] ..... B63G 8/14; B63G 9/00

[52] U.S. Cl. ..... 89/1.11; 114/240 A; 114/245; 367/106; 367/173

[58] Field of Search ..... 114/240 R, 240 A, 242, 114/243, 244, 245; 89/1 A; 181/110, 112; 367/16, 17, 1, 106, 130, 141, 153, 165, 173

[56] References Cited

U.S. PATENT DOCUMENTS 1,378,960 5/1921 Horton .

*Primary Examiner*—David H. Brown

*Attorney, Agent, or Firm*—Michael J. McGowan; Prithvi C. Lall; Michael F. Oglo

[57] ABSTRACT

A stern torpedo defense system uses a pair of passive sonar towed tactical detectors in tandem alignment to detect the presence and trajectory of a stern torpedo attack. The detectors are towed below the wake of a surface ship and include arcuate arrays of transducer elements mounted in low self-noise, roll pitch and yaw stabilized platforms. The region aft of the stern of the ship is examined by an overlapping plurality of preformed passive sonar beams of preselected beamwidth. Signal processing means monitor the power level of the beams and detect the presence and trajectory of an attacking torpedo so that suitable ordinance may timely and effectively be deployed to destroy the torpedo and thereby thwart the attack.

9 Claims, 3 Drawing Sheets

ANTI-TORPEDO STERN DEFENSE SYSTEM

BACKGROUND OF THE INVENTION

The invention relates to acoustic detection devices, and more particularly, to an anti-torpedo detection system intended to be towed behind a ship and to provide information concerning a stern torpedo attack.

A torpedo attack from the stern, or from any other direction such that the torpedo trajectory causes it to curve around and approach from the stern, is very difficult to discern or negate. Most shipboard sonars have difficulty detecting torpedoes under any condition, and usually fail in the stern region because of the high self-noise field in that direction.

Existing towed devices are designed to acoustically lure torpedoes. However, with the existing state of the art, a torpedo attack from the stern has an undesirably high probability of success. Hence, it is desirable to provide a stern defense system that detects the presence and trajectory of a stern torpedo attack so that timely and effective countermeasures can be employed to neutralize the threat.

SUMMARY OF THE INVENTION

The stern defense system of the present invention, comprises a first roll, pitch and yaw stabilized, low self-noise platform; a second roll, pitch and yaw stabilized, low self-noise platform a first arcuate array of transducer elements fixably mounted in the first roll, pitch and yaw stabilized, low self-noise platform; a second arcuate array of transducer elements fixably mounted in the second roll, pitch and yaw stabilized, low self-noise platform; and means, connected to the first and the second platforms, for locating the platforms in tandem alignment under the wake a predetermined distance aft of the stern of a surface ship subject to a torpedo attack.

According to one feature of the present invention, the locating means includes a hydrodynamic depressor which provides a downwardly directed hydrodynamic lift force, and a primary tow cable having first and second segments. The first segment of the primary tow cable is connected between the stern of the surface vessel and the hydrodynamic depressor; the second segment of the primary tow cable is connected between the hydrodynamic depressor and the first platform. The second platform is aft of the first platform and is connected thereto by a secondary tow cable. A rope drogue is connected aft of the second platform.

According to another feature of the present invention, each of the roll, pitch and yaw stabilized low self-noise platforms has a shape which is the shape of a body of revolution. The length of each of the platforms is the length that corresponds to a fineness ratio selected to provide low drag. Each of the platforms includes an upper and a lower mating half shell. The lower half shell is internally webbed for providing structural support and the upper half shell is an access cover which also serves as an acoustic window.

According to another feature of the present invention, each of the arcuate arrays of transducer elements is positioned above the centerline of the platforms to provide an unobstructed field of view. A beamformer is operatively connected to each of the unobstructed arcuate transducer arrays for forming a plurality of preformed passive sonar beams the field of view of which displays a horizontal azimuth that selectively extends circumferentially about the stern of the surface vessel. Command and control logic is operatively connected to the beamformer for detecting the presence and trajectory of a multiple torpedo attack so that suitable countermeasures can be undertaken to neutralize the threat.

Accordingly, it is an object of the present invention to provide a stern defense system for detecting the presence and trajectory of a multiple torpedo attack.

It is another object of the present invention to provide such a system that utilizes passive sonar signal processing techniques.

It is another object of the present invention to provide such a system that is rugged in construction, reliable in use, easy to maintain and has good acoustical performance.

Other objects, advantages and novel features of the present invention will become apparent by reference to the appended claims, to the following detailed description of the invention and drawings, wherein like parts are similarly designated throughout, and wherein:

DETAILED DESCRIPTION OF THE PREFERRED EMBODIMENT

Figure 1:
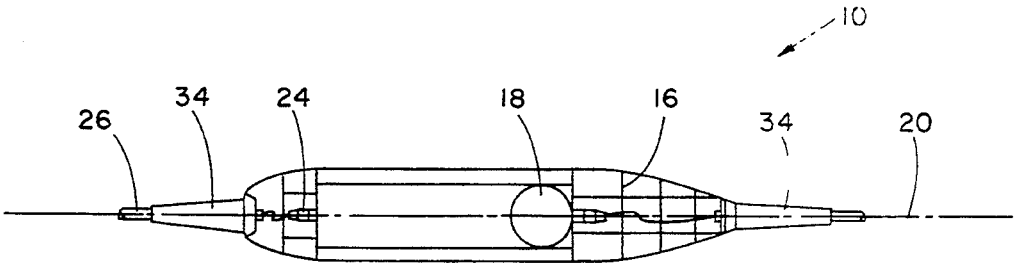
FIG. 1 is a plan view of the towed torpedo detector according to the present invention.
Figure 2:
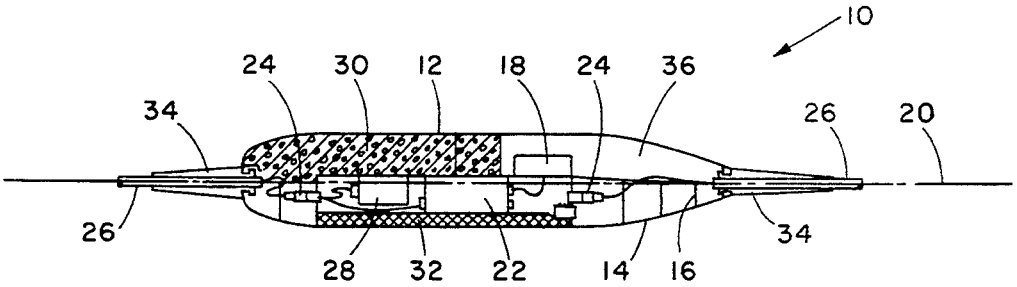
FIG. 2 is a side elevation of the towed torpedo detector according to the present invention.

Referring now to FIGS. 1 and 2, generally shown at 10 is a towed torpedo detector according to the present invention. As will appear more fully below, the towed torpedo detector 10 is used to localize, track and determine the trajectory of torpedos attacking the stern of a vessel in a scenario which develops rapidly in time.

The hydrodynamic resistance encountered by the detector 10 as it is towed through a viscous fluid such as sea water is called drag. To provide a low drag and low self-noise platform, the detector 10 has a shape which is the shape of a body of revolution and a length which is the length that corresponds to a low drag fineness ratio. Preferably, the fineness ratio is selected to be approximately between 5 and 6.

The towed torpedo detector 10 comprises an upper half shell member 12 and a lower mating half shell member 14. The upper half shell member 12 serves as an access cover and an acoustic window and may be fashioned from any suitable material such as stainless steel, aluminum and Rho-C rubber. The lower mating half shell member 14 is the main structural member for the detector 10. The lower mating half shell member 14 is internally webbed as shown at 16 to provide the stiffness and the strength necessary to couple towing loads and resist handling damage. The member 14 may be fashioned of any suitable material such as aluminum, stainless steel, poly carbonate and fiberglass.

A circular arc array of transducer elements 18 is fixably mounted in the detector 10 above a horizontal centerline 20 to provide an unobstructed field of view. The array 18 is operatively connected through an electronics module 22 and waterproof connectors 24 to a mechanical tether and telemetry cable 26. A compass 28, which may be of the magnetic flux type, is also operatively connected through the connectors 24 to the cable 26. The function of the module 22 and the compass 28 will appear more fully below.

Buoyant, low acoustic loss foam 30 is bonded to the upper half shell member 12 to enhance the stiffness of the member 12 and to reduce flow excited noise. Lead ballast 32 is provided in the lower mating half shell member 14. It will be appreciated that the foam 30 and the ballast 32 cooperate to provide roll stability of the detector 10.

Bend limiting and strain relief members 34 are provided at anchor points fore and aft of the detector 10. The members 34 act to terminate the towing loads transmitted through the tow cable strain members and to protect the tow cables from being subject to excessive bend stresses during handling. It is to be noted that all spaces, other than those used for foam and instrumentation, such as a cavity 36 formed between the upper half shell member 12 and the transducer array 18, are free flooded.

Figure 3:
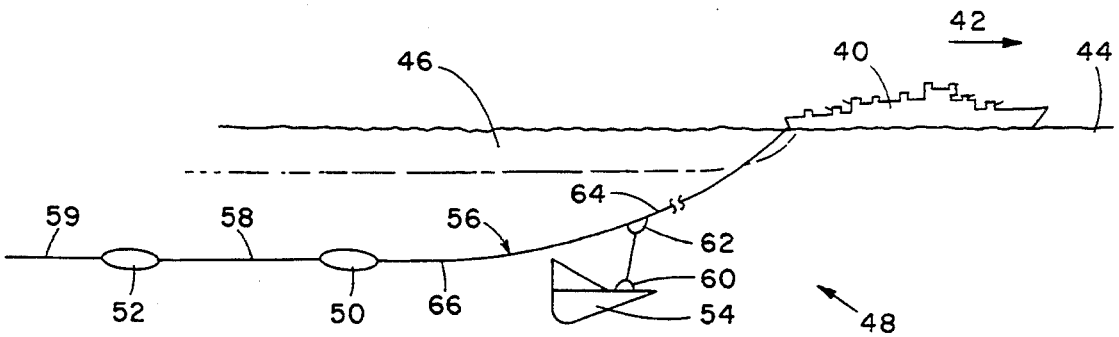
FIG. 3 is a schematic illustrating the stern defense system of the present invention.

Referring now to FIG. 3, a surface ship 40 is shown moving in a direction 42 through a medium 44 such as the ocean. As a result of the motion of the ship in the direction 42 through the medium 44, a wake 46 is generated in the stern region of the vessel 40. As shown, the vessel 40 is provided with a stern defense system generally designated at 48. The stern defense system 48 comprises a first towed torpedo detector 50, a second towed torpedo detector 52, a hydrodynamic depressor 54, a primary tow cable 56, a secondary tow cable 58 and a rope drogue 59. Pitch and yaw stability of towed torpedo detector 50 is provided by the drogue effect of the towed torpedo detector 52 and pitch and yaw stability of towed torpedo detector 52 is provided by the rope drogue 59. It will be appreciated as the invention becomes better understood that the detectors need not be absolutely stable but only stabilized enough to avoid large and potentially destructive excursions. When necessary, the use of stabilizing fins, not shown, may be employed to enhance the longitudinal stability of the detectors 50 and 52.

The detectors 50 and 52 are located a predetermined distance aft of the stern of the vessel 40 and are under the wake 46. Preferably, the detectors 50 and 52 are located aft of the stern approximately in the ratio 3:4.

The hydrodynamic depressor 54 generates a downwardly directed lift force and may be of any suitable design. An example of such a depressor 54 is the commercially available "V fin" ® depressor available from Fathom Oceanology Ltd, 863 Rangeview Road, Port Credit, Ontario. The depressor 54 is attached to the primary tow cable 56 by a short flexible cable yoke 60 and a cable clamp 62. The cable clamp 62 allows the depressor 54 to be rapidly and positively attached or detached from the primary tow cable 56 during the launch or the recovery phase. A pin, not shown, is fitted to the depressor/yoke tow point to provide a fail safe attachment in the event that the depressor becomes fouled with either the sea bottom or debris thus protecting the tow cable from accidentally breaking and endangering the deck crew. It is to be noted in this connection that any other means to locate the detectors 50 and 52 under the wake 46, such as a very heavy tow cable or weights, may be utilized in lieu of or in addition to the depressor 54.

The primary tow cable 56 and the secondary tow cable 58 serve not only to provide a mechanical tether between the ship 40 and the detectors 50 and 52 but also provide an electrical conduit for handling the signal telemetry and power requirements of the towed torpedo detectors 50 and 52.

The primary tow cable 56 has two segments 64 and 66. The segment 64 of the primary tow cable 56 which extends between the stern of the ship 40 and the anchor point 62 of the hydrodynamic depressor 54 must handle significantly higher torques than the segment 66 of the primary cable 56 which extends between the anchor point 62 of the hydrodynamic depressor 54 and the first towed torpedo detector 50.

Preferably, the segment 64 is a torque balanced contrahelically wrapped steel filament strain member having a RG213 electrical core coax. The segment 66 of the tow cable 56 trailing aft of the depressor anchor point 62 preferably is a "Kevlar" ® braid strain member also having a RG213 electrical core coax. The secondary tow cable 58, which is the length of cable that extends between the towed torpedo detector 50 and the towed torpedo detector 52, preferably is of the same construction as the segment 66 of the primary tow cable 56.

Figure 4:
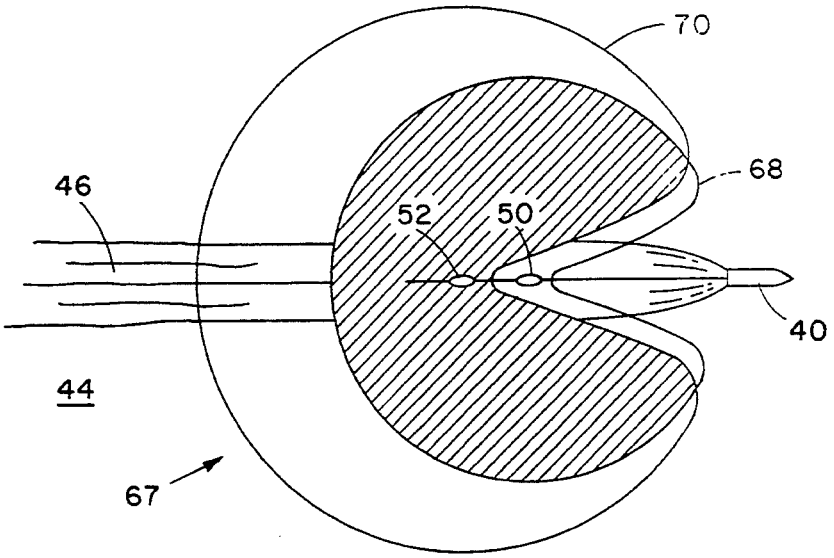
FIG. 4 is a diagram illustrating the acoustic performance of the stern defense system of the present invention.

Referring now to FIG. 4, generally shown at 67 is a diagram illustrating the acoustic performance of the stern defense system of the present invention. The circular arc array of transducer elements 18 fixably mounted in each of the platforms 50 and 52 provides a plurality of preformed passive sonar beams the field of view of which displays a horizontal azimuth that selectively extends circumferentially about the stern of the ship 40 as shown at 68 and 70 respectively. The cross-hatched area shows that region of the acoustic medium 44 where the fields of view 68 and 70 overlap. Due to the interference provided by the ship 40, it will be appreciated that no passive sonar beams are utilized in the region intermediate the ship 40 and the detectors 50 and 52.

Figure 5:
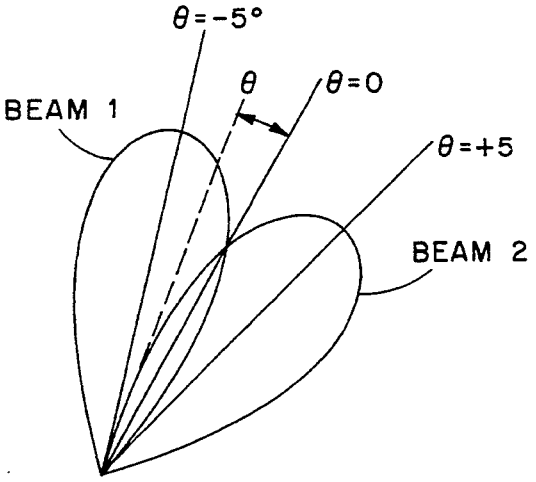
FIG. 5 is a diagram illustrating the beam amplitude comparison geometry of the stern defense system of the present invention.

The bearing of a threat is estimated by amplitude comparison between adjacent beams. Assume for the purpose of explanation that each of the plurality of passive sonar beams formed by the detectors 50 and 52 has a ten degree beamwidth and are nominally 3 dB down at the beam crossovers, as shown in FIG. 5. The beam shapes (power) are approximately cosine squared with the angle for the arguement of the cosine function varying at 9 times the spatial angle. The angle $\Theta$, which represents the deviation of an observed threat from the centerline between beams, can be determined from power measurements in adjacent beams. The output of beam one is:

$$P_1 = P\cos^2(9\Theta - 45°); \quad (1)$$

and that from beam 2 is:

$$P_2 = P\cos^2(9\Theta + 45°). \quad (2)$$

Taking the difference over the sum of these outputs:

$$\frac{P_1 - P_2}{P_1 + P_2} = \frac{P\cos^2(9\theta - 45°) - P\cos^2(9\theta + 45°)}{P\cos^2(9\theta - 45°) + P\cos^2(9\theta + 45°)}, \text{ and} \quad (3)$$

solving for Θ, yields:

$$\theta = \frac{1}{18} \arcsin \frac{P_1 - P_2}{P_1 + P_2}. \quad (4)$$

Figure 6:
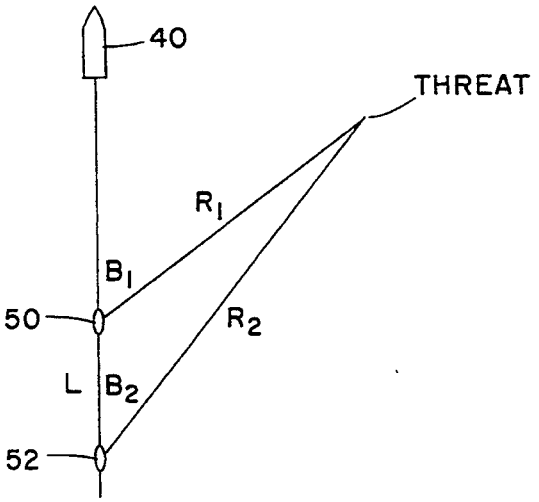
FIG. 6 is a diagram illustrating the towed detector triangulation geometry of the stern defense system of the present invention.

The towed detectors 50 and 52 provide an estimation of range by the method of triangulation, as shown in FIG. 6. The range estimated is preferably the range from the first towed detector 50, marked $R_1$ in FIG. 6, which is deduced from bearing measurements $B_1$ and $B_2$ from the two detectors using the law of sines:

$$R_1 = \frac{L \sin B_2}{\sin(B_1 - B_2)}. \quad (5)$$

It will be appreciated, that after the presence including the range and bearing of a threat is known, suitable countermeasures, such as the launching of anti-torpedo weapons, may be timely and effectively employed to neutralize the threat.

Figure 7:
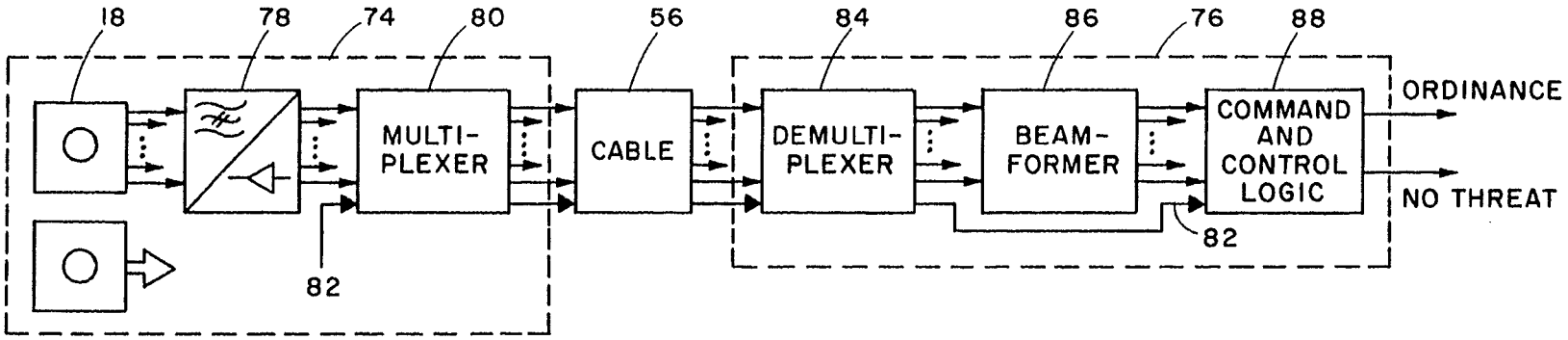
FIG. 7 is a simplified block diagram showing the electronic system of the stern defense system of the present invention.

Referring now to FIG. 7, generally designated at 72 is a simplified block diagram of Due channel of the electronic system of the present invention. Electronic system 72 includes a wet end electronics sub-system 74 and a dry end electronics sub-system 76.

The wet end electronic sub-system preferably includes a filter/preamplifier 78 and a multiplexer 80. The multiplexer 80 repetitively samples at or above the Nyquist rate the filtered and amplified electrical output signals produced by the arrays of transducer elements 18 and, along with an electrical signal 82 produced by the compass 28, repetitively transmits this information in a manner well known to those skilled in the art over the telemetry and towing cable 56 to the surface ship 40.

The dry end electronic sub-system preferably includes a demultiplexer 84 feeding a beamformer 86 which is operatively connected to command and control logic 88. The beamformer 86, which may be of any suitable time shift or phase delay type, forms the plurality of preformed passive sonar beams about the arcuate arrays 18 fixably mounted in the detectors 50 and 52 the field of view of which displays the azimuths 68 and 70. As above discussed, those preformed beams that display that azimuth that extends about the region intermediate the towed detectors 50 and 52 and the ship 40 are blanked-out because of the propeller generated noise in the region of the ship's stern. As will appear more fully below, the command and control logic 88 operates on the output of the beamforming module 86 in such a manner as to identify the presence and trajectory of a stern torpedo attack and controls the laying of suitable ordinance to neutralize the attack.

Figure 8:
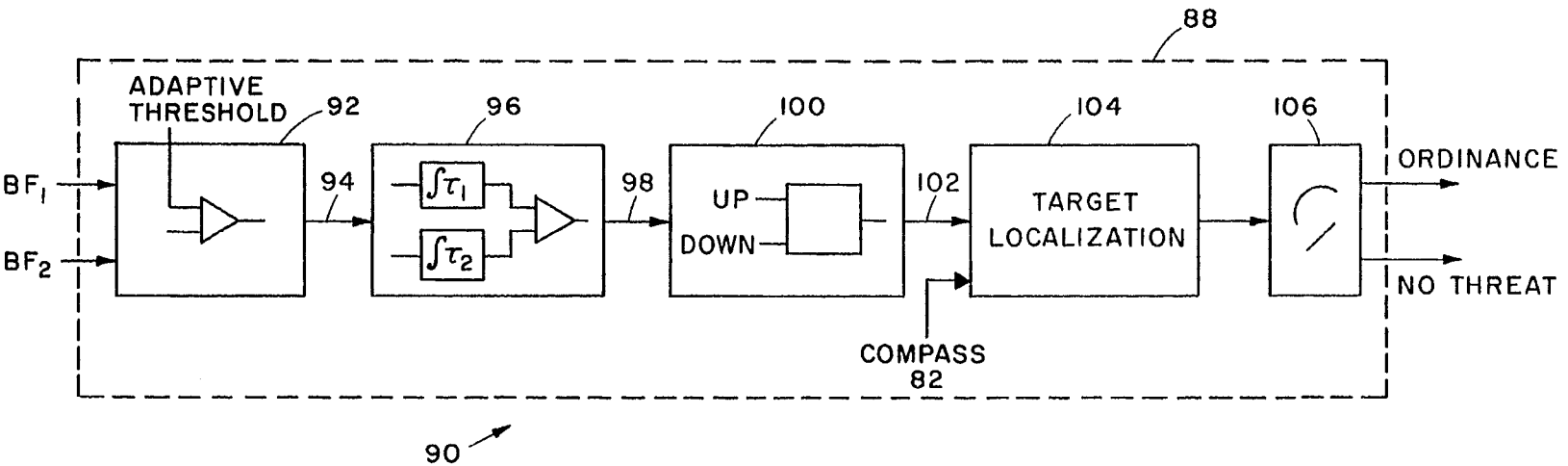
FIG. 8 is a simplified block diagram showing the command and control logic of the electronic system of the stern defense system of the present invention.

Referring now to FIG. 8, generally shown at 90 is a stylized and simplified block diagram of the command and control logic 88 of the electronics system 72 of the present invention.

The plurality of preformed passive sonar beams provided by the beamforming modules, designated $BF_1$ and $BF_2$ in FIG. 8, are fed through a yaw-compensation module 92, which compares the magnitude of each beam with an adaptively chosen threshold. The threshold is adaptively chosen based on the highest interference level over a yaw cycle of the detectors 50 and 52 in situ.

The highest interference level occurs when the peak of a beam sidelobe faces a major noise source on the ship 40. Variations in interference due to peaks and valleys of the beam sidelobe structure passing through the ships noise thus will fall below the threshold and not trigger a false detection. A signal over line 94 occurs when at least one closing torpedo causes a ramp of noise to rise above the threshold adaptively set by the pattern of yaw induced interference.

Once a torpedo is detected over the yaw induced interference in a beam in the module 92, the apparent detection signal 94 is evaluated in a temporal normalization module 96 which distinguishes dynamic torpedo signals from static interference. An integration of the signal over the long term, designated as $\tau_1$, is expected to be comparatively stable, while over the short term, designated as $\tau_2$, an integration of the signal will produce a magnitude that will be large or small depending on whether a torpedo is present or not. Thus, for each interval evaluated, an output from the module 96 appears on line 98 provided the short term average exceeds the long term average of an apparent detection. In this manner, the temporal normalization module 96, which may comprise a well known arrangement of operational amplifiers and integrators, accounts for and distinguishes between static and dynamic effects.

A scoring module which may comprise a well known up-down counter arrangement, is used to evaluate the consistency of the normalized signals 98; it can be expected that a torpedo will consistently be above the long term average. Levels in a beam or in successive beams are examined during successive intervals. The score is increased (count "up") for each interval in which the level exceeds the long term average and decreased (count "down") with each interval devoid of signal. Transient effects are eliminated, while a consistent signal accumulates to an alarm level. In this manner, the module 100 provides a measure of protection to within an acceptable probability against launching ordinance against a false attack.

With the appearance of an alarm signal on line 102, a target localization module 104 computes the range and bearing of the threat in accordance with equations (1) through (5), above. The module 104 utilizes the compass signal 82 to compute the range and bearing of the threat in true-earth coordinates in a manner well known to those skilled in the art. A target motion analysis module 106 analyzes the range and bearing data and computes the most probable trajectory of the torpedo so that ordinance may be laid-on at a position intended to intercept and destroy the attacking torpedo.

In summary, the novel stern defense system of the present invention comprises a tandem arrangement of low self-noise, roll, pitch and yaw stabilized platforms having arcuate arrays of transducer elements for examining an azimuth region at the stern of a surface ship by an overlapping plurality of preformed passive sonar beams.

By means of well known signal processing techniques, the electronic modules of the novel stern defense system of the present invention compensate for tow ship noise in situ, utilize a temporal normalization network to distinguish between static and dynamic effects, provide a measure of protection to within an acceptable probability against launching ordinance against a false attack and analyze a present threats range, bearing and trajectory to null, by suitable countermeasures, the potential ravage inflicted by a stern torpedo attack.

It is to be clearly understood that many modifications of the herein shown and described invention may be effected without departing from the scope of the appended claims.

What is claimed is:

1. In a medium wherein a surface ship having a wake is subject to an attack from the stern of said ship by at least one torpedo, a passive stern defense system, comprising:

a first roll, pitch and yaw stabilized, low self-noise platform;

a second roll, pitch and yaw stabilized, low self-noise platform;

a first arcuate array of transducer elements, said first arcuate array fixably mounted in said first roll, pitch and yaw stabilized, low self-noise platform;

a second arcuate array of transducer elements, said second arcuate array of transducer elements fixably mounted in said second roll, pitch and yaw stabilized low self-noise platform;

means, connected to said first and said second roll, pitch and yaw stabilized low self-noise platforms, for locating said platforms in tandem alignment under said wake a predetermined distance aft of said stern of said ship;

a beamformer, operatively connected to said first and second arcuate transducer arrays, for forming a plurality of preformed passive sonar beams, the field of view of which displays a horizontal azimuth that selectively extends circumferentially about said stern of said surface vessel; and command and control logic operatively connected to said beamformer for detecting the presence and trajectory of said at least one torpedo.

2. (C) A passive stern defense system as recited in claim 1, wherein said locating means includes a hydrodynamic depressor for providing downwardly directed hydrodynamic lift, and a primary tow cable having first and second segments;

said first segment connected between said stern of said surface vessel and said hydrodynamic depressor, and said second segment connected between said depressor and said first platform.

3. (C) A passive stern defense system as recited in claim 2, wherein said second platform is aft of said first platform, and further including a secondary tow cable connected between said first platform and said second platform.

4. (C) A passive stern defense system as recited in claim 3, further including a rope drogue connected aft of said second platform.

5. (C) A passive stern defense system as recited in claim 1, wherein each of said roll, pitch and yaw stabilized low self-noise platforms has a shape which is the shape of a body of revolution.

6. (C) A passive defense system as recited in claim 5, wherein each of said platforms has a fineness ratio selected to provide low drag.

7. (C) A passive stern defense system as recited in claim 6, wherein said fineness ratio is approximately between five (5) and (6).

8. (C) A passive stern defense system as recited in claim 5, wherein each of said platforms comprises upper and lower mating half shells, said lower half shell is internally webbed for providing structural support and said upper half shell is an access cover serving as an acoustic window.

9. (C) A .passive Stern defense system as recited in claim 8, wherein each of said arcuate transducer arrays are positioned between said acoustic window and the centerline of each of said platforms.

* * * * *